US008281418B2

(12) United States Patent
Cohen, Jr.

(10) Patent No.: US 8,281,418 B2
(45) Date of Patent: Oct. 9, 2012

(54) ONE-PIECE PROTECTIVE DEVICE

(75) Inventor: Jeriah Darrel Cohen, Jr., Decatur, GA (US)

(73) Assignee: Jeriah Darrel Cohen, Jr., Sanford, FL (US)

( * ) Notice: Subject to any disclaimer, the term of this patent is extended or adjusted under 35 U.S.C. 154(b) by 0 days.

(21) Appl. No.: 11/820,616

(22) Filed: Jun. 20, 2007

(65) Prior Publication Data

US 2008/0127401 A1 Jun. 5, 2008

Related U.S. Application Data

(60) Provisional application No. 60/872,473, filed on Dec. 4, 2006.

(51) Int. Cl.
*A41D 13/00* (2006.01)

(52) U.S. Cl. ..... 2/465

(58) Field of Classification Search ..... 2/79, 227, 2/228, 22, 23, 2.5, 267, 465, 459, 69, 910, 2/455, 102, 115
See application file for complete search history.

(56) References Cited

U.S. PATENT DOCUMENTS

| | | | | |
|---|---|---|---|---|
| 3,771,171 | A * | 11/1973 | Mitchell | 2/2.5 |
| 4,507,801 | A * | 4/1985 | Kavanagh et al. | 2/462 |
| 4,866,789 | A * | 9/1989 | Dorm | 2/462 |
| 6,289,524 | B1 * | 9/2001 | Wright et al. | 2/455 |
| 7,257,846 | B2 * | 8/2007 | Paciorkowski | 2/267 |

* cited by examiner

*Primary Examiner* — Tejash Patel
(74) *Attorney, Agent, or Firm* — Raynarldo Whitty, Esq.

(57) ABSTRACT

A one-piece protective device includes a shirt member and a pants member. The shirt member includes a proximal end comprising a neck area and a distal end comprising a waist area. The pants member includes a proximal end and a distal end, wherein the proximal end of the pants member is integrally joined with the distal end of the shirt member to form the waist area. The one-piece device is compressed around the body of the user to conform about the contour and shape of the user.

The one-piece protective device also includes a plurality of pockets formed within the shirt member and pants member, wherein a plurality of pads disposed within the plurality of pockets. The device also includes a plurality of fasteners, such as zippers and fasteners, for securing the pads within the pockets. An elastic band is disposed at the waist to hold the device around the waist area of the user. The one-piece protective device is fabricated from stretchy material to provide increased elasticity.

20 Claims, 5 Drawing Sheets

ONE-PIECE PROTECTIVE DEVICE

RELATED APPLICATIONS

This application claims priority to provisional application No. 60/872,473 filed on Dec. 4, 2006, the entire disclosure of which is incorporated by reference herein.

FIELD OF THE INVENTION

The present invention generally relates to athletic apparel. More specifically, the present invention is drawn to a one-piece garment constructed to house the protective padding needed to participate in high impact sporting events, such as football.

DESCRIPTION OF THE RELATED ART

Football pads are utilized to provide protection to players during football games. These protective pads must be properly worn during both practice and games to guard against serious injury in the high impact sport of football. Standard football uniforms provide padding for protection of the major body parts that are exposed, such as the shoulders, thighs, hips and knees.

The process of adding and removing the uniforms can consume an inordinate amount of time. Each separate pad must be properly secured in place in the uniform pants to protect the body parts. For example, the shoulder pads must be separately attached to the body of the user before putting on the remainder of the uniform on top of the shoulder pads. Furthermore, because of shoulder pad configuration and bulk, it is often necessary for a player to require some assistance when donning a jersey. However, it is a necessity because of the protection provided to the user's upper extremities, such as the breast plate, upper ribs, spine and collarbone. Many devices in the prior art require the shoulder pads to be attached to the player be strapping the pads around the shoulders are arm pits of the player. However, due to the difficulty in securely attaching the shoulder pads around the user's shoulders, the shoulder pads often shift during the impact of collision during football games. The movement of the shoulder pads results in undue injuries to the spine and shoulders of the user.

Many known devices in the prior art, also include a structure that does not conform to the shape or contour of the user's body. In addition, the material oftentimes comprises polyurethane or similar plastic material that is difficult to facilitate and manipulate when a player is attempting to put on his uniform.

Additionally, the user must protect his lower extremities of his body which can be equally as time consuming. For example, the protective pads of the lower body, such as the thigh, knee and hip pads, must be separately and individually secured to a portion of the uniform before the user can completely prepare for a game. Thus, valuable time is loss-time that must be added to practice or game-day schedules, time that could be better spent on the practice field or discussing game strategy.

Also, because of cost and inconvenience, it is currently common practice that the pads are only washed at the end of the football season. This practice contributes to staph and other bacterial infections. The art would certainly welcome a system that would allow a player to reduce the amount of time taken to don, remove and clean football gear. Thus football apparel solving the aforementioned problems is desired.

There are many related art disclosures that pertain to one-piece athletic garments. Pertinent samples of such related art are cited and identified in the accompanying IDS. However, none of the cited and identified related art, taken either singly or in combination, is seen to disclose a one-piece football suit as will subsequently be described and claimed in the instant invention.

What is needed is a one-piece protective device that can quickly and easily engaged to a user's body, requires minimal effort to attach and remove to the body of user during usage, and provides increased protection to the body of the user during impact and collision. Also, the one-piece uniform device should require minimal time and effort to operate and adjust during an actual game.

SUMMARY OF THE INVENTION

In one aspect of the invention, a one-piece protective device, such as a football suit, includes a shirt member and a pants member. The shirt member includes a front and a back and extending from a neck area to a waist area. The pants member is integrally formed with the shirt member and joined with the shirt member at the waist area. The one-piece protective device also includes a plurality of pockets formed within the shirt member and the pants member.

The one-piece protective device further includes a plurality of pads disposed in the plurality of pockets to protect against injury during the impact of collision during actual use in games, such as football. In addition, a plurality of fasteners, such as zippers and hook and loop fasteners, are utilized for securing the pads into the pockets of the device. The pockets are disposed at various strategic areas of the device. Each pocket is designed to contain a specific protective pad. For instance, a pair of shoulder pads can be disposed between a first surface and a second surface of the shirt member to secure the shoulder pads to the one-piece protective device.

As presently contemplated, the respective pockets of the device can also be utilized to provide protection to other areas of the user's body, such as the thighs, hips, knees and butt, by securing the respective pads in the specific area. For example, the one-piece protective device may comprise a pair of hip pads disposed between a first surface and a second surface of the pants member to secure the hip pads to the one-piece protective device. Additionally, the one-piece protective device may comprise a pair of knee pads disposed between a first surface and a second surface of the pants member to secure the knee pads to the one-piece protective device. Likewise, the one-piece protective device may comprise a butt pad disposed between a first surface and a second surface of the pants member to secure the butt pad to the one-piece protective device.

In another aspect of the present invention, the one-piece protective device may include a plurality of fasteners, such as zippers and/or hook and loop fasteners, to secure the pads and prevent movement of the pads inserted within the pockets of the device. The plurality of pockets form a receptacle to secure the pads to during the impact of a collision, which provides increased protection to the user and prevents serious injury to the protected areas of the user's body. This increased protection protects the user from serious injury during high impact activities, such as football.

When inserting or removing a pad within a pocket of the one-piece protective device, the zipper is aligned in an open position to allow the pad to be positioned into a pocket of the one-piece protective device. Conversely, when securing a pad from within a pocket of the device, the zipper is aligned in a closed position to allow the pad to be stabilized into a pocket of the one-piece protective device. The zippers can be composed of any material known in the art and can be designed so that it remains unnoticeable during usage. The ability to maneuver the zipper from an open to closed position allows the pads to be easily and efficiently removed incase a pad needs to be removed as a result of damage or repair.

In another aspect of the present invention, the one-piece suit device may include an opening positioned between a proximal end and a distal end of the one-piece protective device for securing the one-piece protective device to the body of a user. In addition, the opening may further comprise a fastener positioned along the opening which extends from the front of the shirt to just below the waist. The fastener allows the shirt member to be freely opened and closed for securing the one-piece protective device around the body of a user.

In yet another aspect of the present invention, the one-piece protective device may include an elastic band disposed along the waist area of the pants member for securing the one-piece protective device around the body of a user. The elastic band is used to hold the suit tight to the waist and hip area of the user during performance. Additional elastic bands can be attached to the device to form a jockey strap or similar device.

The one-piece protective device may also be composed from a stretchy material suitable to allow the device to fit snugly around the contour and shape of the user's body. The material may also comprise Miratex to provide increased elasticity of the uniform during the impact of collision during sports, such as football.

In another aspect of the present invention, a method of maneuvering a one-piece protective device comprises the steps of providing a shirt member, wherein the shirt member includes a front and a back and extending from a neck area to a waist area and providing a pants member, wherein the pants member is integrally formed with the shirt member and joined with the shirt member at the waist area. The method further includes the steps of providing a plurality of pockets formed in the shirt member and in the pants member. The method also includes the step of providing a plurality of pads disposed in the plurality of pockets located along the one-piece protective suit. The method also includes a plurality of fasteners for securing the plurality of pads within the plurality of pockets, in addition to a primary fastener for securing the one-piece protective device along an opening of the device.

Accordingly, the invention presents a one-piece football suit that incorporates all key padding therein. The one-piece protective device will minimize the amount of time it takes for a user to dress and undress for athletic events, such as football. The one-piece protective device also enhances the ease of washing the intact padding and increases the overall cleanliness of the device. The invention provides for improved elements thereof in an arrangement for the purposes described that are inexpensive, dependable and fully effective in accomplishing their intended purposes.

A clear understanding of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
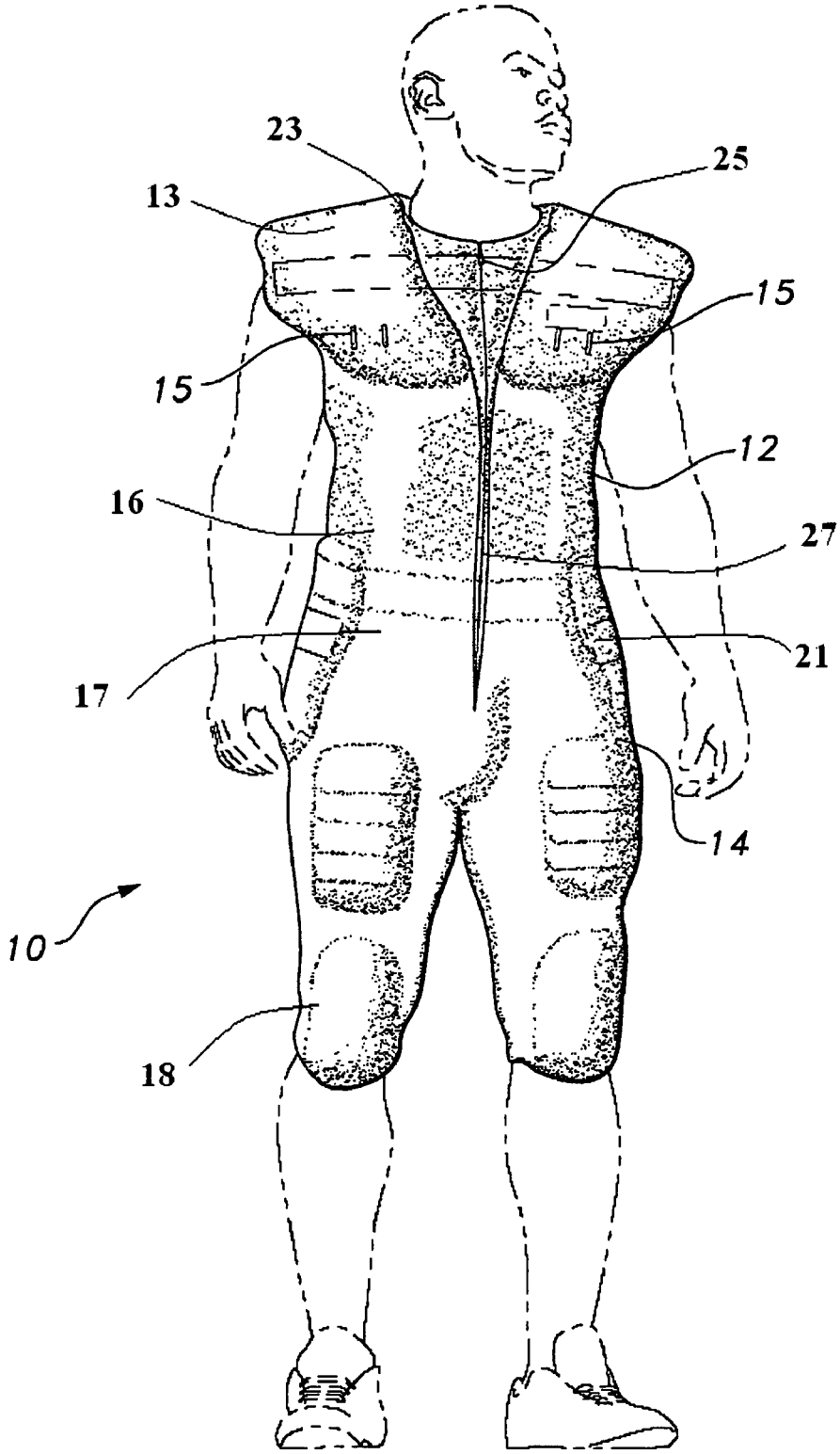
FIG. 1 is an environmental, front view of a one-piece football uniform according to the present invention.

The invention is described with reference to the drawings in which like elements are referred to by like numerals. The relationship and functioning of the various elements of this invention are better understood by the following detailed description. However, the embodiments of this invention are not limited to the embodiments illustrated in the drawings. It should be understood that the drawings are not to scale and in certain instances details have been omitted, which are not necessary for an understanding of the present invention, such as conventional fabrication and assembly.

Referring now to FIG. 1, a one-piece protective device 10 of the present invention is shown. The device 10 comprises a shirt member 12 and a pant member 14. The shirt member 12 includes a proximal end 13 comprising a neck area 23 and a distal end 16 comprising a waist area 21. The pants member 14 includes a proximal end 17 and a distal end 18, wherein the proximal end 17 of the pants member 14 is integrally joined with the distal end 16 of the shirt member 12 to form the waist area 21.

In this embodiment of the present invention, the shirt member 12 and the pants member 14 are integrally joined to form the one-piece protective device 10. The device 10 is fabricated from a suitable stretchy material so as to tightly conform to the shape and contour of the user's body. The device 10 may also comprise a detachable member 12*a* comprised of material affixed to the rear of the shirt (see FIG. 2). The detachable member 12*a* is utilized to attach an area of material which comprises the name of the individual user and assists in identifying the user during sporting activities, such as football. Additional indicia can be affixed to the front of the shirt member 12 or sides of the pants member 14 if desired.

Figure 2:
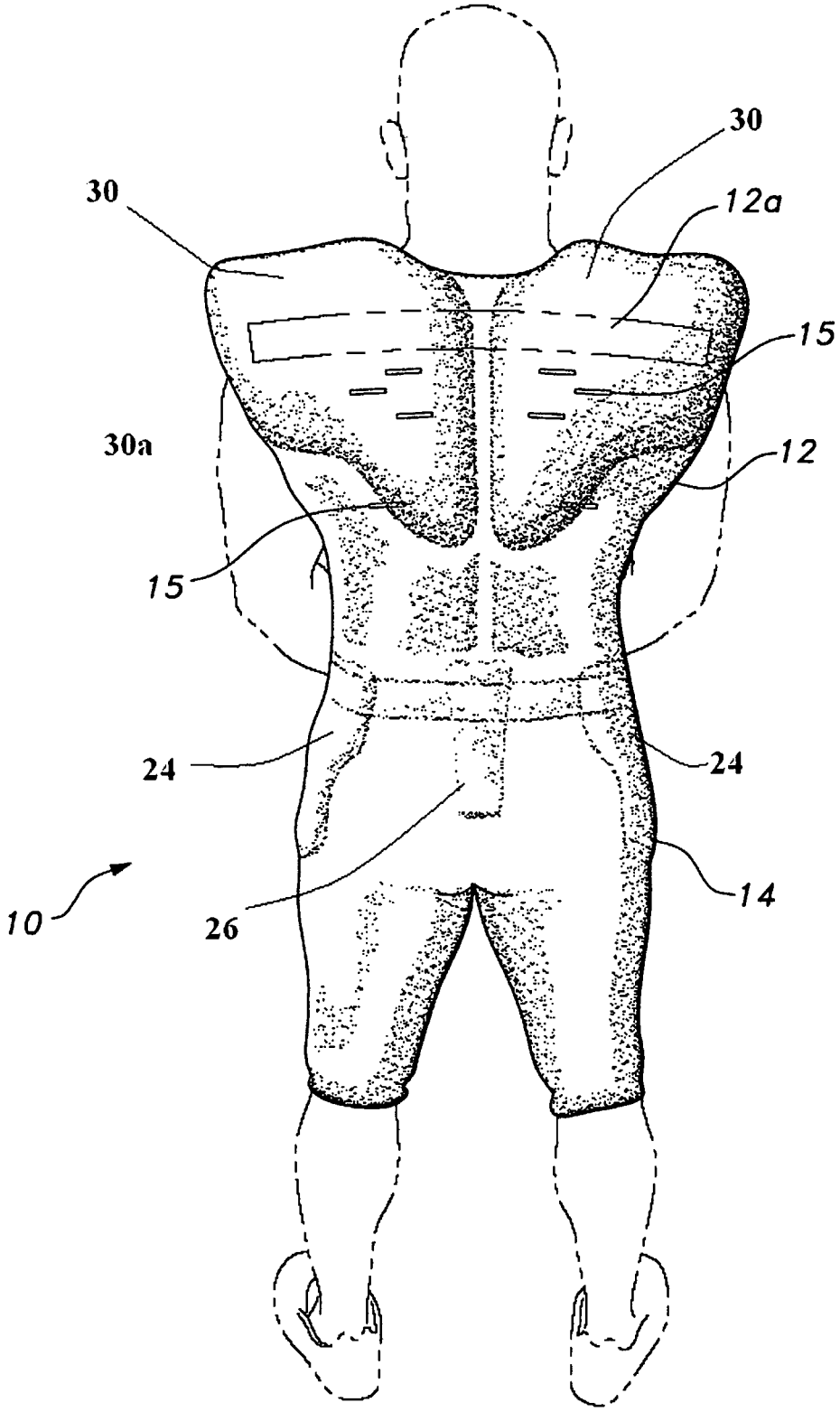
FIG. 2 is an environmental, rear view of a one-piece football uniform according to the present invention.
Figure 3:
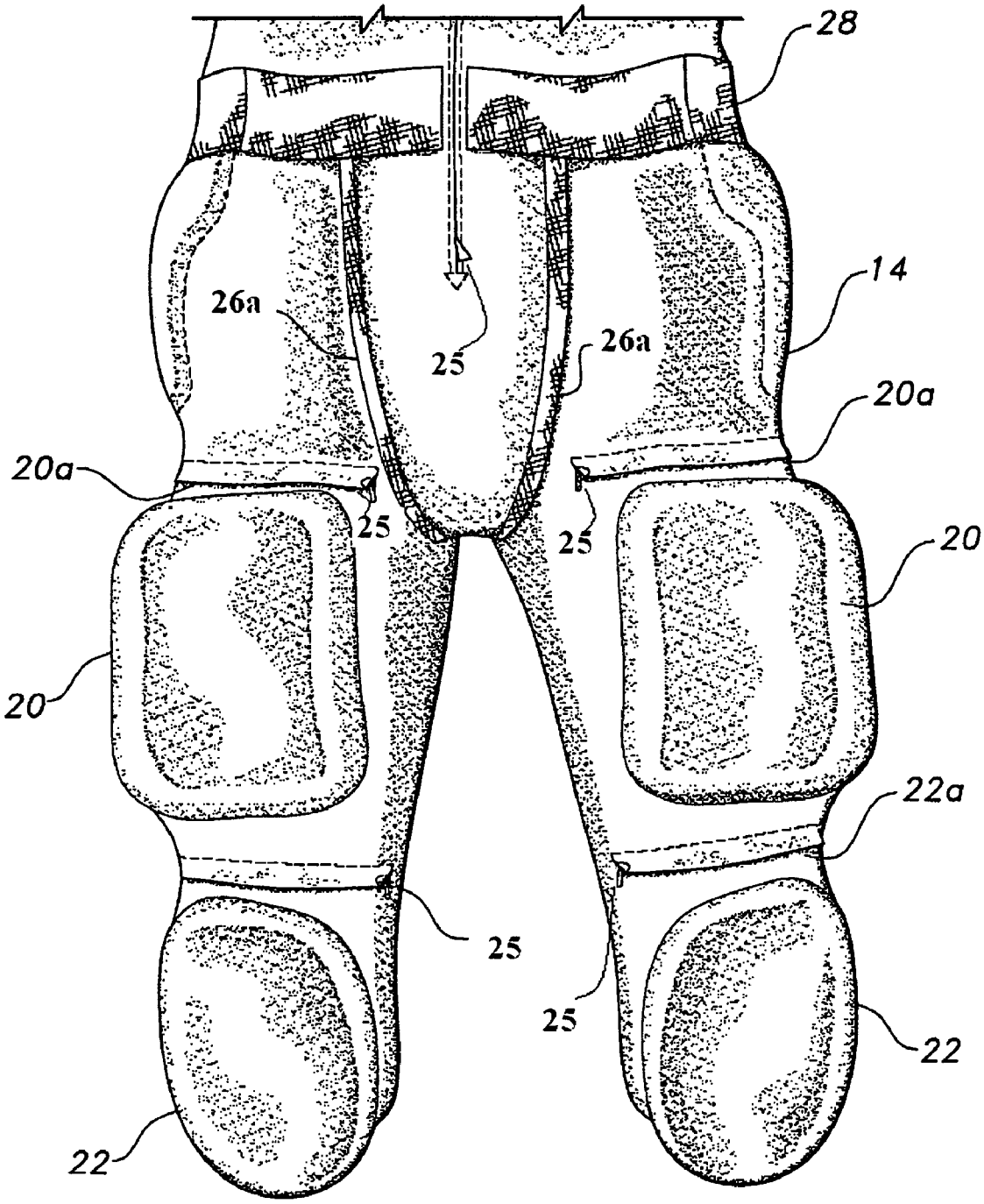
FIG. 3 is a partial inverted front view of the pants of a one-piece football uniform according to the present invention.

Referring now to FIGS. 2-3, the one-piece protective device 10 further includes a plurality of pads 20, 22, 24, 26, 30 disposed within the plurality of pockets 20*a*, 22*a*, 24*a*, 26*a*, 30*a* to protect against injury during the impact of collision during actual use in games, such as football. In addition, a plurality of fasteners 25, such as zippers and hook and loop fasteners, are utilized for securing the pads 20, 22, 24, 26, 30 into the pockets 20*a*, 22*a*, 24*a*, 26*a*, 30*a* of the device 10. The pockets 20*a*, 22*a*, 24*a*, 26*a*, 30*a* are disposed at various strategic areas of the device 10. Each pocket 20*a*, 22*a*, 24*a*, 26*a*, 30*a* is designed to contain a specific protective pad. For instance, a pair of shoulder pads 30 can be disposed between a first surface and a second surface of the shirt member 12 to secure the shoulder pads 30 to the one-piece protective device 10. The shoulder pads 30 reduce the force of impact on the user during collisions, such as in football tackling, and reduces the resulting injuries to the user's body.

The respective pockets 20*a*, 22*a*, 24*a*, 26*a*, 30*a* of the device 10 can also be utilized to provide protection to other areas of the user's body, such as the thighs, hips, knees and butt, by securing the respective pads 20*a*, 22*a*, 24*a*, 26*a*, 30*a* in the specific area. Thus, the one-piece protective device 10 may comprise a pair of hip pads 24 disposed between a first surface and a second surface of the pants member 14 to secure the hip pads 24 to the one-piece protective device 10. Additionally, the one-piece protective device 10 may comprise a pair of knee pads 22 disposed between a first surface and a second surface of the pants member to secure the knee pads 22 to the one-piece protective device 10. The one-piece protective device 10 may also comprise a butt pad 26 disposed between a first surface and a second surface of the pants member 14 to secure the butt pad 26 to the one-piece protective device 10.

The pants member 14 may also include a plurality of fasteners 25, such as zippers and/or hook and loop fasteners, to secure the pads 20, 22, 24, 26, 30 and prevent movement of the pads 20, 22, 24, 26, 30 inserted within the pockets 20*a*, 22*a*, 24*a*, 26*a*, 30*a* of the device 10. The plurality of pockets 20*a*, 22*a*, 24*a*, 26*a*, 30*a* form a receptacle to secure the pads 20, 22, 24, 26, 30 during the impact of a collision, which provides increased protection to the user and prevents serious injury to the protected areas of the user's body. This increased protection protects the user from serious injury during high impact activities.

When inserting or removing pads 20, 22, 24, 26, 30 from within a pocket 20*a*, 22*a*, 24*a*, 26*a*, 30*a* of the one-piece protective device 10, the fastener 25 is aligned in an open position to allow the pad to be positioned into the pocket 20*a*, 22*a*, 24*a*, 26*a*, 30*a* of the one-piece protective device 10. Conversely, when securing a pad 20, 22, 24, 26, 30 into a pocket 20*a*, 22*a*, 24*a*, 26*a*, 30*a* of the device, the fastener 25 is aligned in a closed position to allow the pad 20, 22, 24, 26, 30 to be stabilized into the pocket 20*a*, 22*a*, 24*a*, 26*a*, 30*a* of the one-piece protective device 10. The fasteners 25 can be composed of any material known in the art and can be designed so that it remains unnoticeable during usage. The ability to maneuver the fasteners 25 from an open to closed position allows the pads 20, 22, 24, 26, 30 to be easily and efficiently removed incase a pad needs to be removed as a result of damage or repair.

Referring now to FIG. 3, the pants member 14 of the device 10 are shown in an inverted configuration. The inside surface of the pants member 14 are used to house the pockets 20*a*, 22*a*, 24*a*, 26*a* and pads 20, 22, 24, 26 to provide increased protection to the lower extremities of the user during the impact of collision. The pockets 20*a*, 22*a*, 24*a*, 26*a* provide openings at the top thereof for receiving pads 20, 22, 24, 26 therethrough to be retained in the pockets 20*a*, 22*a*, 24*a*, 26*a*. The pockets 20*a*, 22*a*, 24*a*, 26*a* are adapted to retain the pads 20, 22, 24, 26 and the elastic material of the pockets 20*a*, 22*a*, 24*a*, 26*a* allows the pockets 20*a*, 22*a*, 24*a*, 26*a* to snugly fit around the contour of the pads to prevent movement within the pockets 20*a*, 22*a*, 24*a*, 26*a*.

Figure 4:
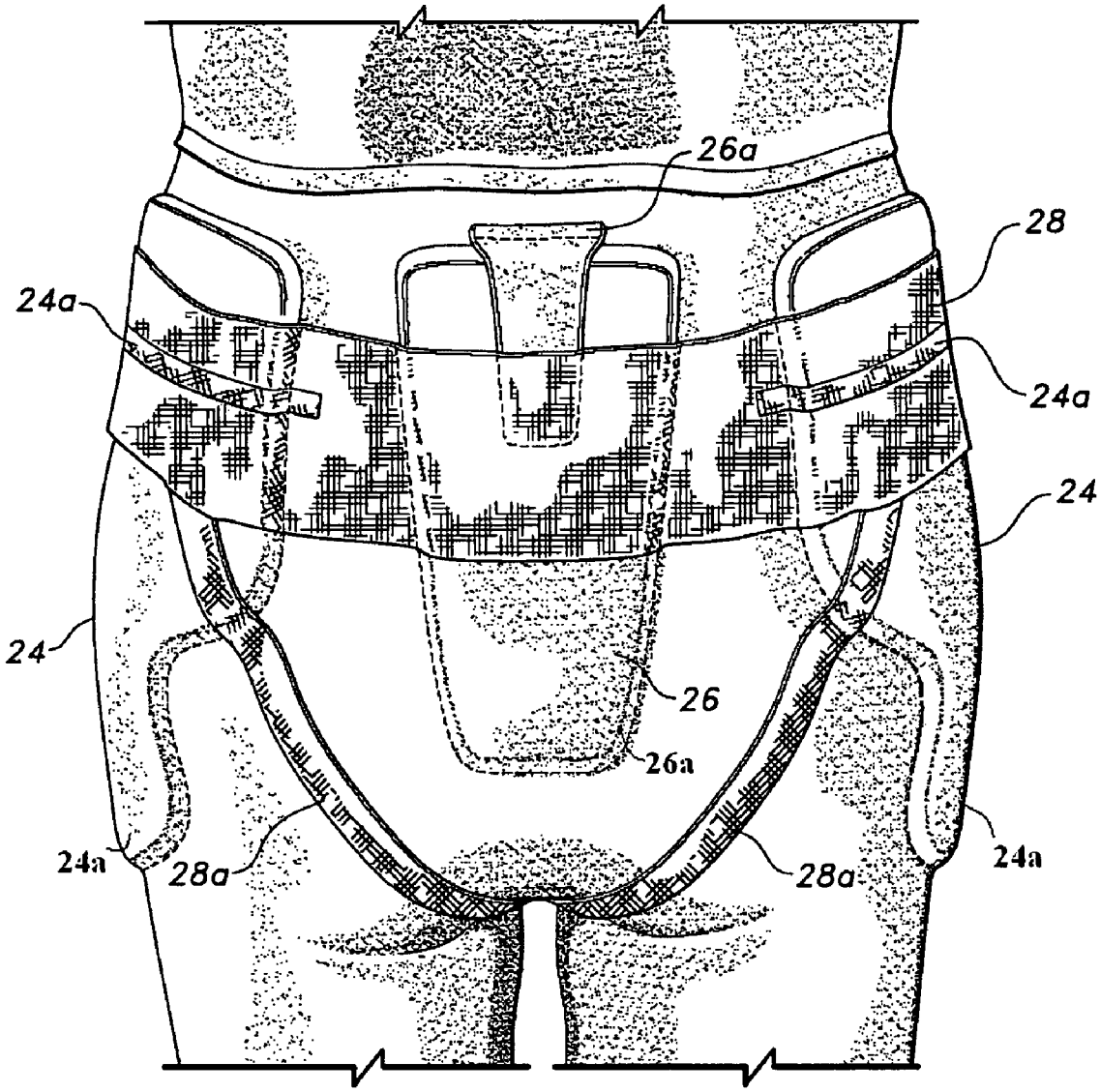
FIG. 4 is a partial inverted rear view of the pants of a one-piece football uniform according to the present invention.

Referring now to FIG. 4, the fasteners 25 are used to close the open tops of pockets 20 and 22 to secure the respective pads in the pockets. As best seen in FIG. 4, hip pads 24 are disposed in pockets 24*a* located at the sides of pants member 14. The pocket 26*a* to retain the butt pad 26 is disposed at the rear of pants member 14. Hook and loop fasteners are also utilized to retain the respective pads in pockets 24*a* and 26*a*.

The one-piece protective device 10 is configured to receive and hold the user's body snugly within an opening 27 that extends from the proximal end 13 of the shirt member 12 to the waist area of the device 10. The opening 27 is closed with the fastener 25 which is coextensive with the opening 27 of the shirt member 12. In another embodiment of the present invention (not shown), the opening 27 can extend along the back portion of the device 10, wherein the user can be secured within the device 10 from a backwards direction.

The one-piece protective device 10 also includes a waist member 28, such as an elastic band, disposed along the waist area 21 of the pants member 14 for securing the one-piece protective device 10 around the body of a user. The waist member 28 encircles the waist area 21 to assist in retaining the hip pads 24 and butt pads 26 in their proper positions. The waist member 28 can be designed to open when the fastener 25 is opened below the waist area 21. In an alternate embodiment, the waist member 28 can incorporates support straps 28*a*, which straps function to form a jockey strap. The waist member 28 is used to hold the suit tight to the waist and hip area of the user during performance. Additional elastic bands can be attached to the device 10 to form a jockey strap or similar device.

The one-piece protective device 10 may also be composed from a stretchy material suitable to allow the device 10 to fit snugly around the contour and shape of the user's body. The material may also comprise Miratex to provide increased elasticity of the device 10 during the impact of collision during sports, such as football or similar physical activity. The device 10 may also comprise material such as microfiber, polyethylene or other similar material known in the art. The elastic material allows the device 10 to fit onto the user's body similar to a compression suit and increases the overall protection during impact. The elastic material further allows the user's body to maintain body temperature and moisture levels during high performance activities such as football. In addition to increased protection, the lightweight design of the device 10 increases the overall performance and speed of the user by reducing the total weight carried by the body of the user.

Figure 5:
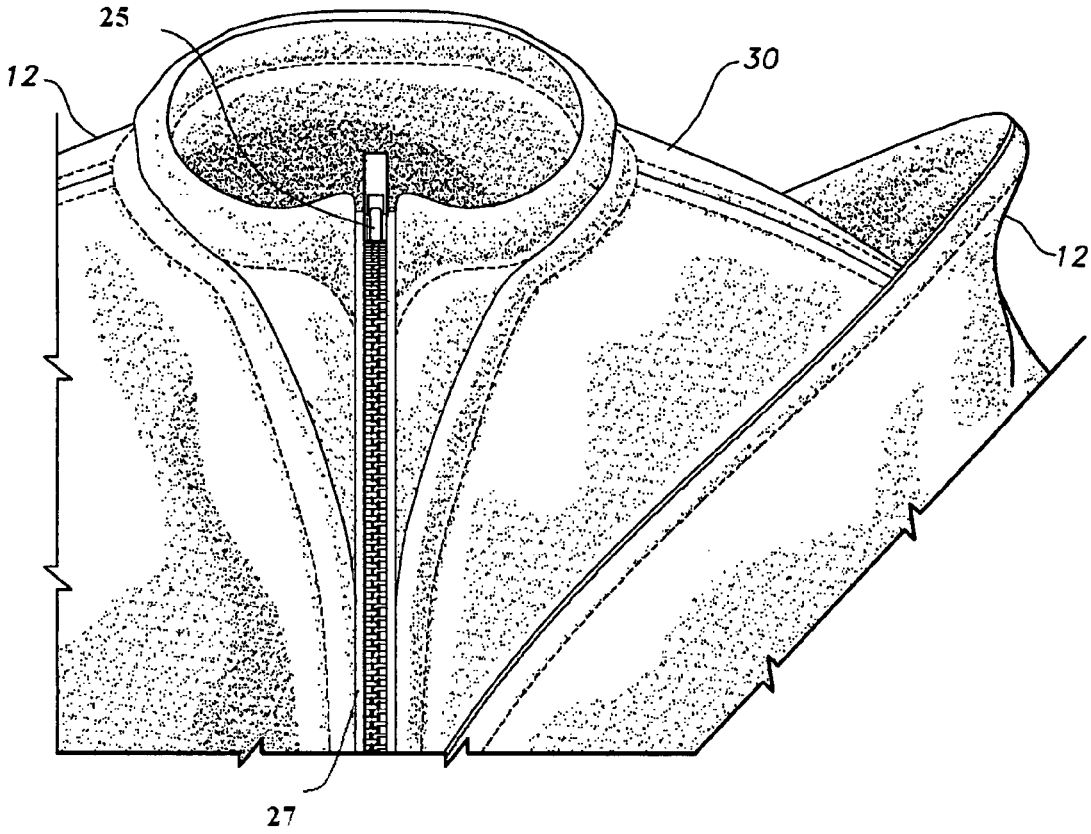
FIG. 5 is a partial view of the shirt and shoulder pad arrangement of a one-piece football uniform according to the present invention.

Referring now to FIG. 5, a sectional view of the shirt member 12 of the device 10 is illustrated, wherein the pockets 30 of the shoulder pads 30*a* are illustrated. The shirt member 12 further comprises a plurality of slits 15 are positioned about the chest area and across the upper back of the surface of the shirt member 12 for securing the shoulder pad 30*a*. The shoulder pads 30*a* can be comprised of a pliable and elastic material that allows the pads 30 to conform to the shape of the user's upper body for increased protection. Conventional shoulder pads are composed of plastic shells, which may limit mobility and range during performance and impact. The composition of the shoulder pads of the present invention provides increased support during impact and increased mobility as a result of the positioned within the device 10.

Another embodiment of the present invention provides a method of maneuvering a one-piece protective device comprising the steps of providing a shirt member, wherein the shirt member includes a proximal end comprising a neck area and a distal end comprising a waist area, and providing a pants member, wherein the pants member is integrally formed with the shirt member and joined with the shirt member at the waist area. The method further includes the steps of providing a plurality of pockets formed in the shirt member and in the pants member. The method also includes the step of providing a plurality of pads disposed in the plurality of pockets located along the one-piece protective suit. The method also includes a plurality of fasteners for securing the plurality of pads within the plurality of pockets, in addition to a primary fastener for securing the one-piece protective device along an opening of the device.

The above figures and disclosures are intended to be illustrative and not exhaustive. This description will suggest many variations and alternatives to one of ordinary skill in the art. All such variations and alternatives are intended to be encompassed within the scope of the attached claims. Those familiar with the art may recognized other equivalents to the specific embodiments described herein which equivalents are also intended to encompass by the attached claims. Moreover, the use of this invention on a wire guide is not a limitation of the claims. Use of this device with other tubing and elongate medical devices used in medical procedures and the like is understood to be within the scope of the claims.

It is to be understood that the present invention is not limited to the embodiment described above, but encompasses any and all embodiments within the scope of the following claims.

The invention claimed is:

1. A one-piece protective device, comprising:

a shirt member, wherein the shirt member includes a proximal end comprising a neck area and a distal end comprising a waist area;

a pants member, wherein the pants member includes a proximal end and a distal end, wherein the proximal end of the pants member is integrally joined with the distal end of the shirt member to form the waist area;

a plurality of pockets formed within the shirt member and the pants member;

a plurality of pads disposed within the plurality of pockets;

a plurality of fasteners for securing the plurality of pads within the plurality of pockets;

an opening positioned between a proximal end and a distal end of the one-piece protective device for securing the one-piece device to the body of a user, wherein the one-piece device is compressed around the body of the user to conform about the contour and shape of the user; and a waist member engaged to at least one hip and butt pads, wherein said waist member is positioned about the waist of the user to provide a means to hold the at least one hip and butt pads in a free position around the waist of the user, wherein said at least one hip and butt pads comprises at least one free end extending downwardly from the waist member.

2. The one-piece protective device according to claim 1, wherein the shirt member and the pants member are fabricated from a stretchy material.

3. The one-piece protective device according to claim 2, wherein the material comprises stretchable material to provide increased elasticity during the impact of collision of the user.

4. The one-piece protective device according to claim 1, wherein a fastener is secured along the opening of the one-piece device to secure a user within the opening of the one-piece protective device.

5. The one-piece protective device according to claim 1, wherein a pair of shoulder pads is disposed between a first surface and a second surface of the shirt member to secure the shoulder pads to the one-piece protective device.

6. The one-piece protective device according to claim 1, wherein an elastic belt is disposed along the waist area of the pants member for securing the one-piece protective device around the body of the user.

7. The one-piece protective device according to claim 1, wherein a pair of hip pads are disposed between a first surface and a second surface of the pants member to secure the hip pads to the one-piece protective device.

8. The one-piece protective device according to claim 1, wherein a pair of knee pads is disposed between a first surface and a second surface of the pants member to secure the knee pads to the one-piece protective device.

9. The one-piece protective device according to claim 1, wherein a butt pad is disposed between a first surface and a second surface of the pants member to secure the butt pad to the one-piece protective device.

10. The one-piece protective device according to claim 1, wherein the plurality of pockets form a receptacle to properly secure the pads to prevent movement of the pads during the impact of a collision.

11. The one-piece protective device according to claim 1, wherein when the fastener is aligned in an open position, a pad can be inserted into a pocket of the one-piece protective device.

12. The one-piece protective device according to claim 1, wherein when the zipper is aligned in a closed position, a pad can be secured into a pocket of the one-piece protective device.

13. A one-piece protective device, comprising:

a shirt member, wherein the shirt member includes a proximal end comprising a neck area and a distal end comprising a waist area;

a pants member, wherein the pants member includes a proximal end and a distal end, wherein the proximal end of the pants member is integrally joined with the distal end of the shirt member to form the waist area;

a plurality of pockets formed within the shirt member and the pants member;

a plurality of pads disposed within the plurality of pockets for securing the plurality of pads within the plurality of pockets;

an opening positioned between a proximal end and a distal end of the one-piece protective device for securing, the one-piece device to the body of a user, wherein the one-piece device is compressed around the body of the user to conform about the contour and shape of the user;

a waist member engaged to at least one hip and butt pads, wherein said waist member is positioned about the waist of the user to provide a means to hold the at least one hip and butt pads in a free position around the waist of the user, wherein said at least one hip and butt pads comprises at least one free end extending downwardly from the waist member; and at least one support strap engaged to said waist member, wherein said support strap forms a jockey strap for securing the protective device about the body of the user.

14. The one-piece protective device according to claim 13, wherein the shirt member and the pants member are fabricated from a stretchy material consisting of Miratex to provide increased elasticity.

15. The one-piece protective device according to claim 13, wherein a fastener extends along an opening positioned between a proximal end and a distal end of the one-piece protective device for securing the one-piece device to the body of a user.

16. The one-piece protective device according to claim 13, wherein a pair of shoulder pads is disposed between a first surface and a second surface of the shirt member to secure the shoulder pads to the one-piece protective device.

17. The one-piece protective device according to claim 13, wherein the plurality of pockets form a receptacle to detachably secure the plurality of pads to prevent movement of the pads during the impact of a collision.

18. The one-piece protective device according to claim 13, wherein when a fastener is aligned in an open position, a pad can be inserted into a pocket of the one-piece protective device.

19. The one-piece protective device according to claim 13, wherein when a fastener is aligned in a closed position, a pad can be secured into a pocket of the one-piece protective device.

20. A method of securing a one-piece protective device to a body of the user during a contact sport, the method comprising the steps of:

providing a shirt member, wherein the shirt member includes a proximal end comprising a neck area and a distal end comprising a waist area;

providing a pants member, wherein the pants member includes a proximal end and a distal end, wherein the proximal end of the pants member is integrally joined with the distal end of the shirt member to form the waist area;

providing a plurality of pockets formed within the shirt member and the pants member;

providing a plurality of pads disposed within the plurality of pockets; and providing a plurality of fasteners for securing the plurality of pads within the plurality of pockets of the device;

providing an opening positioned between a proximal end and a distal end of the one-piece protective device for securing the one-piece device to the body of a user, wherein the one-piece device is compressed around the body of the user to conform about the contour and shape of the user; and providing a waist member engaged to at least one hip and butt pads, wherein said waist member is positioned about the waist of the user to provide a means to hold the at least one hip and butt pads in a free position around the waist of the user, wherein said at least one hip and butt pads comprises at least one free end extending downwardly from the waist member.

* * * * *